US006357453B1

(12) United States Patent
Murtishaw et al.

(10) Patent No.: US 6,357,453 B1
(45) Date of Patent: Mar. 19, 2002

(54) SYSTEM AND METHOD FOR CLEANING CATHODE RAY TUBE FUNNELS PRIOR TO APPLICATION OF INTERIOR COATING

(75) Inventors: David Allen Murtishaw, Sun City; Michael Gerald King; David Cataldo, both of Poway, all of CA (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 0 days.

(21) Appl. No.: 09/873,458

(22) Filed: Jun. 4, 2001

(51) Int. Cl.[7] ..... G08B 9/00

(52) U.S. Cl. ..... 134/22.1; 134/22.11; 134/22.12; 134/22.13; 134/22.16; 134/22.17; 134/26; 134/30; 134/34; 134/35; 134/36; 134/42; 134/95.2; 134/166 R; 134/100.1; 134/169 R

(58) Field of Search ..... 134/22.1, 22.11, 134/22.12, 22.13, 22.16, 22.17, 26, 30, 34, 35, 36, 42, 95.2, 166 R, 100.1, 169 R

(56) References Cited

U.S. PATENT DOCUMENTS 3,746,020 A * 7/1973 Pekosh ..... 134/79
3,837,885 A * 9/1974 Angelucci, Jr. ..... 117/33.5
4,919,157 A * 4/1990 Mateias ..... 134/2
5,344,495 A * 9/1994 Yania et al. ..... 134/22.1
5,797,992 A * 8/1998 Huff ..... 134/7
6,073,639 A * 6/2000 Becker et al. ..... 134/25.4

OTHER PUBLICATIONS

Lewicke, C.K. "Treating lead and fluoride wastes", Environ. Sci. Technol., vol. 6, pp. 321–322, 1972.*

* cited by examiner

*Primary Examiner*—Sharidan Carrillo
(74) *Attorney, Agent, or Firm*—Steven L. Nichols; Rader, Fishman & Graver

(57) ABSTRACT

An improved chemical wash is used to cleanse the interior of an open Cathode Ray Tube ("CRT") funnel before a coating of a carbon material is applied. The traditional ammonium bifloride wash for CRT funnels can be replaced with an aqueous solution of trisodium phosphate ("TSP"). The TSP solution is preferably sprayed under pressure into the open CRT funnels to cleanse each funnel before the interior coating of carbon material is applied. The TSP solution cleanses the funnels as well as the ammonium bifloride wash previously used, but does not tend to clog the wash sprayers. Moreover, the TSP solution does not need to be treated before it is released as waste and costs significantly less that the previous ammonium bifloride wash.

25 Claims, 5 Drawing Sheets

SYSTEM AND METHOD FOR CLEANING CATHODE RAY TUBE FUNNELS PRIOR TO APPLICATION OF INTERIOR COATING

FIELD OF THE INVENTION

The present invention relates to the field of cathode ray tube manufacture. More particularly, the present invention relates to the process of cleaning cathode ray tube funnels before an interior coating is applied. The present invention provides an improved chemical wash that is gentler on the washing equipment, easier to dispose of and provides as thorough a cleansing of the funnel as previous washes at a significant cost savings.

BACKGROUND OF THE INVENTION

Cathode ray tubes ("CRTs") are used in most television sets and computer and video monitors. A typical CRT is illustrated in FIG. 1. The CRT (100) is a glass tube with a bottle-like shape in which a relatively flat bottom portion (101) narrows into an elongated neck portion (102). The relatively flat portion (101) of the CRT (100) becomes the screen on which the display of the television set or monitor is generated when the CRT is incorporated therein. An electro-luminescent material, such as phosphorus, that emits light when struck by an electron beam, is coated over the interior of the screen portion (101) of the CRT (100).

An electron gun (not shown) is then installed in the neck (102) of the CRT (100). A stream of electrons emitted from the electron gun is scanned over the electro-luminescent layer and turned on and off during the scanning to cause the electro-luminescent layer to glow in certain places and not others. In very simple terms, this is how an image is generated on the screen of a television or video monitor. A yoke (not shown) is provided around the neck (102) of the CRT (100). This yoke produces a changing magnetic field through which the electron beam from the electron gun passes. The electron beam is deflected by the magnetic field of the yoke. Consequently, by varying the magnetic field created by the yoke in a precise cycle, the electron beam can be scanned, line-by-line, over the entire surface of the screen to generate video images thereon.

A cathode ray tube is generally constructed in the following matter. The neck (102) or funnel portion of the CRT (100) is formed open at both ends. Then the relatively flat display portion (101) is sealed to the large end of the funnel and the electron gun is installed in the narrow end or neck of the funnel.

The display portion (101) is sealed to the funnel (102) using frit. Frit is a glass paste that can be cured or hardened. Frit (103), in paste form, is applied around the large end of the funnel (102) between the funnel (102) and the display portion (101). The frit is the cured or hardened to form a frit seal (103) between the funnel (102) and the display portion (101).

Before the funnel (102) and display (101) portions are sealed, a coating is applied to the interior of the funnel (102). This coating includes carbon material necessary to the optimal operation of the CRT (100). FIG. 2 illustrates a portion of a CRT production line in which the carbon material coating is applied to the interior of the funnel (102).

As shown in FIG. 2, cathode ray tube funnels (102) are supported during processing on holders or pallets (200). The pallets (200) include a base (201) with supports (202) that hold the funnel (102) in an upright position with the open, large end of the funnel (102) pointing upward. The pallets (200) carrying the funnels (102) may be transported on a conveyor (203).

First, each funnel (102) is brought to the coating application station (205). At the coating application station (205), the coating of carbon material is sprayed into the interior of the funnel (102). A spray head (204) sprays the coating into the open interior of the funnel (102) as the funnel (102) is supported on the pallet (200). Then, the funnel (102) is conveyed into and through a drying oven (206) to dry the newly applied coating.

As noted above, prior to applying the interior coating, the funnel is open at both ends. In particular, the large end of the funnel is open to receive the interior coating before being sealed with a display portion. Consequently, contaminants, such as dust, particulate matter, chemical residues, moisture, etc., can be introduced to and lodge in the open funnels. If this contamination remains when the interior coating is applied inside the funnel, the contamination will degrade both the quality and longevity of the interior coating and the finished CRT.

For these reasons, it is conventional practice to wash each funnel with a chemical wash before the interior coating is applied. This washing is intended to remove all contaminants from the interior of the funnel so that the interior coating can be cleanly and effectively applied.

In the past, ammonium bifloride has been used in the chemical wash for cleansing CRT funnels prior to the application of the interior coating. While ammonium bifloride does an adequate job cleansing the funnel, the ammonium bifloride is also very hard on the equipment used to wash and clean the funnels.

For example, the cleansing wash is typically sprayed from a nozzle or sprayer into the open CRT funnel to clean the funnel. However, the ammonium bifloride tends to clog the sprayer, thereby decreasing the amount of wash delivered to cleanse the funnel. This can obviously result in an incomplete cleansing of the funnel as well as costing time and expense spent to maintain the sprayers in minimal operating condition.

Additionally, the chemical wash containing ammonium bifloride cannot be released as waste until it has been treated to render it safe. Thus, there is an additional expense incurred to treat the waste from an ammonium bifloride washing system before the wastewater can be released into the sewer system.

Consequently, there is a need in the art for an improved method and system of washing cathode ray tube funnels prior to applying interior coatings to those funnels.

SUMMARY OF THE INVENTION

The present invention meets the above-described needs and others. Specifically, the present invention provides an improved method and system of washing cathode ray tube funnels prior to applying interior coatings to those funnels.

Additional advantages and novel features of the invention will be set forth in the description which follows or may be learned by those skilled in the art through reading these materials or practicing the invention. The advantages of the invention may be achieved through the means recited in the attached claims.

The present invention may be embodied and described as a method of cleansing a funnel of a cathode ray tube prior to application of a carbon material coating on an interior of the funnel by washing the cathode ray tube funnel with an aqueous solution of trisodium phosphate. This method preferably includes preparing the aqueous solution of trisodium phosphate by mixing water and trisodium phosphate.

Preferably, the water is heated prior to the mixing of the water and the trisodium phosphate. The mixing of the water and the trisodium phosphate is preferably performed automatically by connecting the output of a water heater with a supply of trisodium phosphate.

The washing of the cathode ray tube funnel with an aqueous solution of trisodium phosphate further is preferably performed by spraying the aqueous solution of trisodium phosphate into the cathode ray tube funnel. The method also preferably includes draining the aqueous solution of trisodium phosphate from the washing chamber where the washing of the cathode ray tube funnel is performed, and may include discarding the aqueous solution of trisodium phosphate without further chemical treatment of the aqueous solution.

After the washing phase, the method of the present invention may include drying the cathode ray tube funnel. The drying of the cathode ray tube is preferably performed by heating air and blowing the heated air on the cathode ray tube funnel to dry the funnel. The method may also include extracting the heated air from the washing chamber in which the washing of the cathode ray tube funnel was performed to facilitate the drying process.

The present invention also encompasses a system or apparatus for performing the method described above. More specifically, the present invention may be embodied in a system for cleansing a funnel of a cathode ray tube prior to application of a carbon material coating on an interior of the funnel. This system would preferably include a washing chamber containing the funnel of the cathode ray tube; and an aqueous solution of trisodium phosphate supplied into the washing chamber to wash the funnel of the cathode ray tube.

This system may also preferably include a supply line for supplying the aqueous solution of trisodium phosphate to the washing chamber; a metered supply of trisodium phosphate connected to the supply line; and a water line connected to the supply line. The water line may preferably include a water heater.

To wash the funnel, the system preferably includes a sprayer connected to the supply line for spraying the aqueous solution on the funnel. A drain system may be provided for draining the aqueous solution of trisodium phosphate from the washing chamber.

A drying system may be connected to or incorporated in the washing chamber for drying the cathode ray tube funnel following the washing of the cathode ray tube funnel with the aqueous solution of trisodium phosphate. The drying system preferably includes a heater/blower unit for heating air and blowing heated air into the washing chamber to dry the funnel. The drying system also preferably includes an exhaust system for exhausting the heated air from the washing chamber.

BRIEF DESCRIPTION OF THE DRAWINGS

The accompanying drawings illustrate preferred embodiments of the present invention and are a part of the specification. Together with the following description, the drawings demonstrate and explain the principles of the present invention.

Throughout the drawings, identical elements are designated by identical reference numbers.

DETAILED DESCRIPTION OF THE PREFERRED EMBODIMENTS

The present invention provides an improved chemical wash that is used to cleanse the interior of an open Cathode Ray Tube ("CRT") funnel before a coating of a carbon material is applied. Under the principles of the present invention, the traditional ammonium bifloride wash for CRT funnels can be replaced with an aqueous solution of trisodium phosphate ("TSP"). The TSP solution is preferably sprayed under pressure into the open CRT funnels to cleanse each funnel before the interior coating of carbon material is applied. The TSP solution cleanses the funnels as well as the ammonium bifloride wash previously used, but does not tend to clog the wash sprayers. Moreover, the TSP solution does not need to be treated before it is released as waste and costs significantly less that the previous ammonium bifloride wash.

Figure 3A:
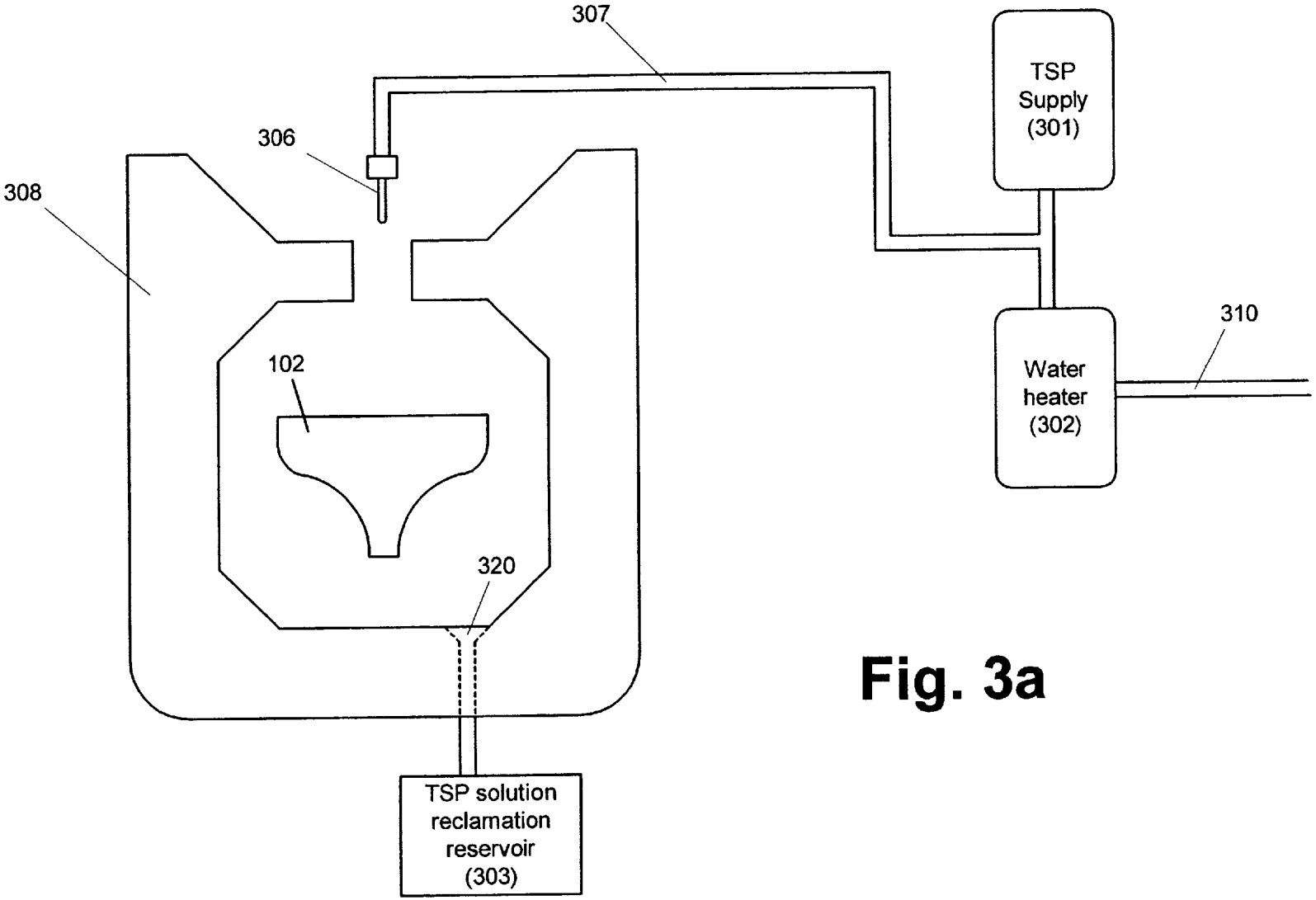
FIG. 3*a* is an illustration of a system according to the present invention for cleansing cathode ray tube funnels prior to the application of an interior coating using, for example, the system illustrated in FIG. 2.

FIG. 3*a* is an illustration of a system according to the present invention for cleansing cathode ray tube funnels prior to the application of an interior coating. As will be apparent to those skilled in the art, FIG. 3*a* is a conceptual illustration and does not show in unnecessary detail all the known machinery and systems used to prepare, deliver and reclaim a chemical wash being used to cleanse a CRT funnel.

As shown in FIG. 3*a*, each CRT funnel (102) is placed in a washing chamber (308). The funnel (102) is preferably oriented with the large open end directed upward. As explained below, the cleansing wash, which is an aqueous TSP solution, will preferably be sprayed into the large open end of the funnel (102).

To the right in FIG. 3*a*, the system for preparing and delivering the aqueous TSP solution is illustrated. This system preferably includes a water heater (302) that receives a flow of water from a water supply line (310). The water heater (302) then heats the water for use in preparing the aqueous TSP solution.

A supply of trisodium phosphate ("TSP") (301) is also provided. TSP is also known as sodium phosphate, tribasic; trisodium orthophosphate; tertiary sodium phosphate; and sodium orthophosphate, tertiary.

TSP is prepared commercially by mixing soda ash and phosphoric acid in proper proportions to form disodium phosphate. Caustic soda is then added to form trisodium phosphate. The result is a powder of colorless crystals that are soluble in water. TSP is non-flammable, but is toxic if ingested and an irritant to human tissue.

The TSP supply (301) of the present invention preferably includes an amount of powdered or crystallized TSP that is metered and mixed into a flow of heated water from the water heater (302). The result is an aqueous solution of TSP that can be used to cleanse the interior of the CRT funnel prior to application of the interior carbon material coating.

The optimal percentage of TSP per water volume in the aqueous solution can be varied to achieve the cleaning effect desired based on such considerations as the equipment used and the time allotted for the cleansing process. The optimal percent solution range will be readily discoverable to one of ordinary skill in the art. Any percent solution that is effective as a cleaner for the interior of a CRT funnel is within the scope of the present invention.

The aqueous TSP solution prepared by mixing water from the water heater (302) and TSP from the TSP supply (301) is delivered through a supply line (307) to a sprayer or nozzle (306). The aqueous TSP solution is then sprayed, preferably under pressure, from the sprayer (306) into the open CRT funnel (102). The supply line (307) may include a pump or pump system to increase the pressure of the TSP solution being sprayed from the sprayer (306).

As the solution emerges from the spray (306), it washes over and cleanses the waiting funnel (102) of any contaminants. Thus the funnel, particularly the interior of the funnel, is cleansed to prepare the funnel for the application of an interior carbon material coating.

A reclamation system (320) may also be incorporated in the washing chamber (308) to drain the aqueous TSP solution from the washing chamber (308) after it has passed over or through the funnel (102). The recovered solution may be collected in a TSP solution reclamation reservoir (303) connected to the reclamation system (320).

However, a significant advantage of the present invention is that the TSP solution does not have to be treated before it is released as waste into, for example, a common sewer system. Consequently, the TSP solution can be simply drained from the washing chamber (308) and discarded. Alternatively, the TSP solution can be collected, e.g., in the reservoir (303), and then discarded or recycled.

Figure 3B:
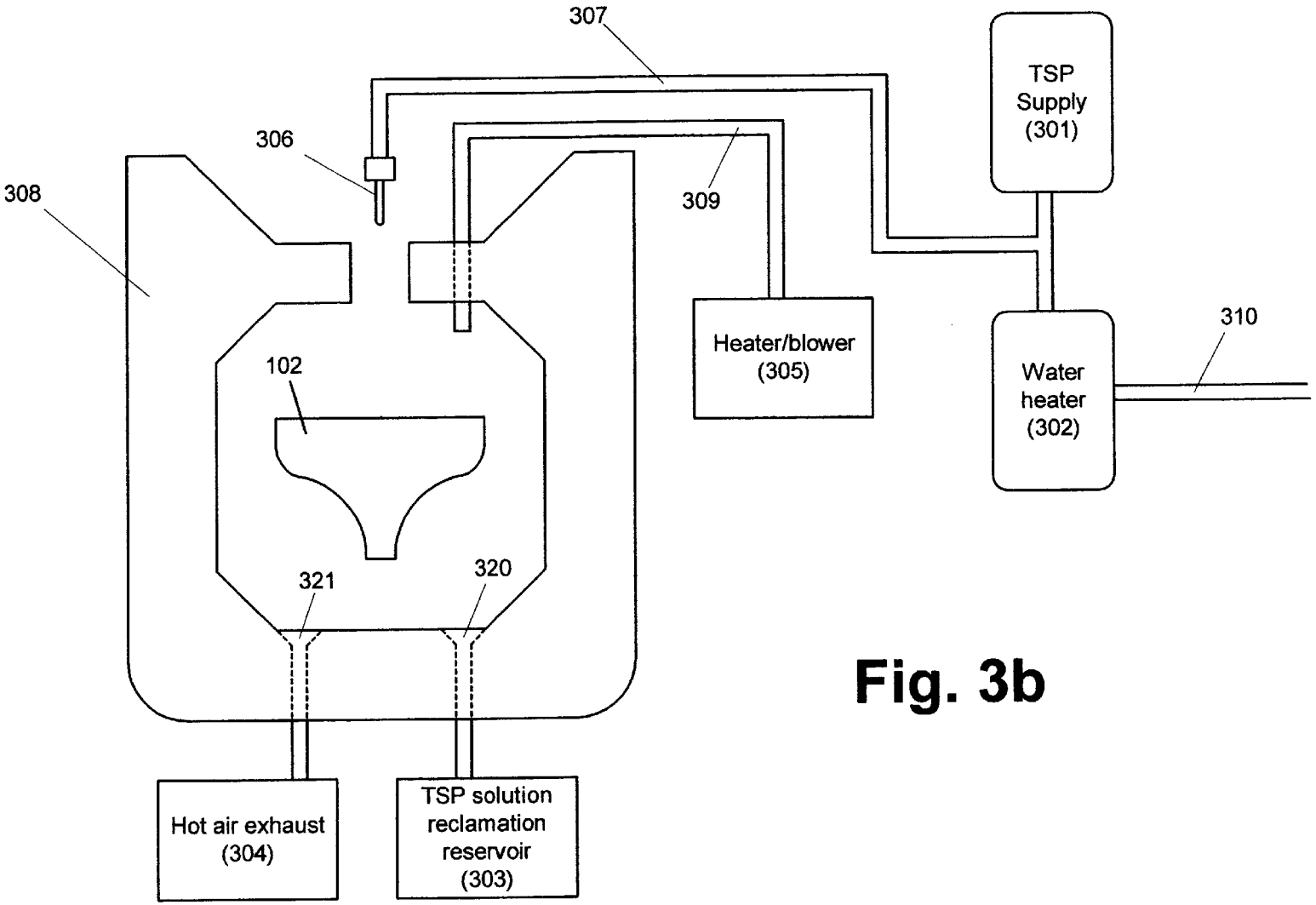
FIG. 3*b* is an illustration of the system of FIG. 3*a* with the addition of a funnel drying system according to the principles of the present invention.

FIG. 3*b* is an illustration of the system of FIG. 3*a* with the addition of a funnel drying system according to the principles of the present invention. As shown in FIG. 3*b*, a drying system (304, 305, 309) is preferably incorporated into the washing chamber (308) to dry each CRT funnel (102) after the funnel (102) has been washed using the TSP solution of the present invention.

A heater/blower unit (305) intakes and heats ambient air. The heater/blower unit (305) then forces the heated air through a duct (309) and into the washing chamber (308). Preferably, the heater/blower unit (305) is not activated until the washing of the funnel (102) using the aqueous TSP solution is complete.

Within the washing chamber (308), the duct (309) is preferably aimed at or into the funnel (102) so that the heated air from the heater/blower unit (305) is forced over, around and through the funnel (102). According to well-known principles, this heated air dries the funnel (102) after the wash with aqueous TSP solution.

An exhaust duct (321) is provided within the washing chamber (308) to exhaust the heated air forced in through the supply duct (309). The exhaust duct (321) may be connected to a hot air exhaust system (304) including, for example, an extraction fan for pulling the heated air from the heater (305) through and out of the washing chamber (308). In this way, the funnel (102) can be effectively and quickly dried following a cleansing wash with aqueous TSP solution.

Figure 4:
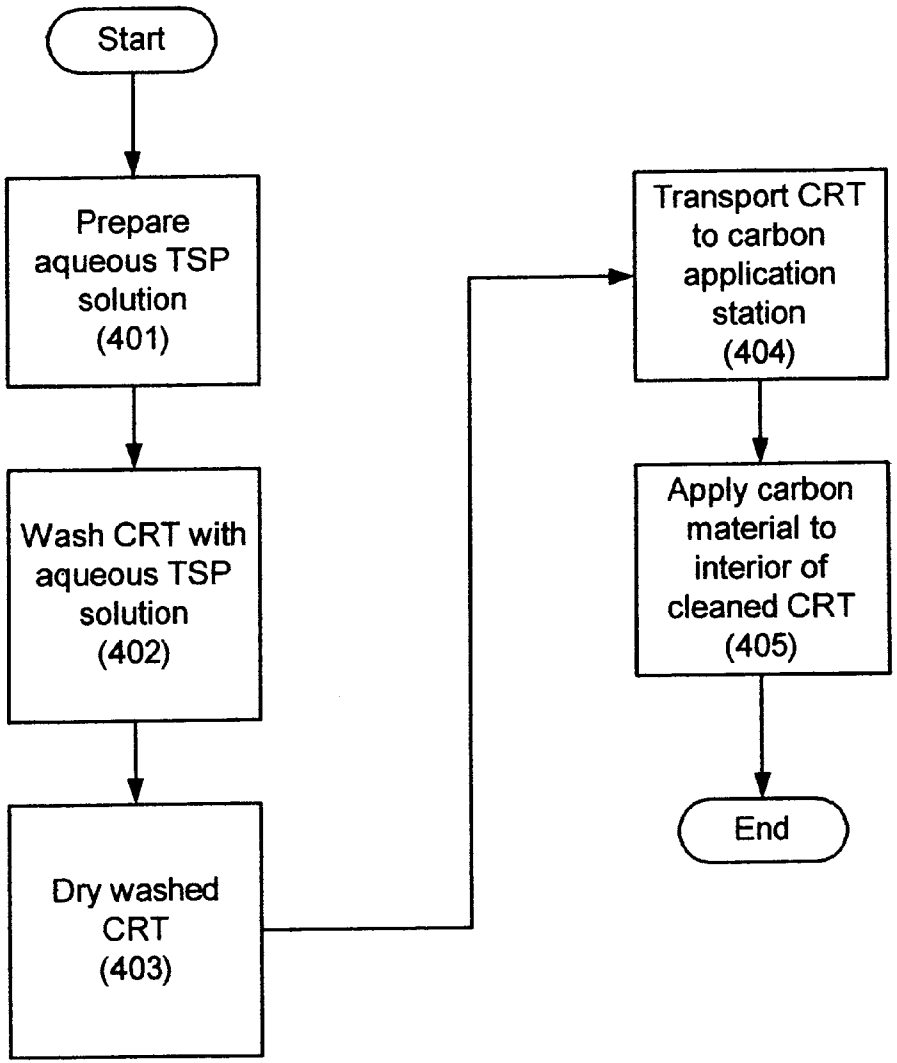
FIG. 4 is a flowchart illustrating a preferred method of the present invention.

FIG. 4 is a flowchart illustrating a preferred method of the present invention. As shown in FIG. 4, an aqueous TSP solution is first prepared (401). As illustrated in FIGS. 3*a* & 3*b*, the system of the present invention may include a supply of TSP and a source of heated water with a common supply line or other apparatus for mixing the TSP into the water to prepare the aqueous TSP solution. Alternatively, the aqueous TSP solution may be prepared outside the delivery system and supplied to the system in a ready-to-use form that can be supplied to and sprayed from the sprayer (306, FIGS. 3*a* & 3*b* into a waiting CRT funnel.

Additionally, the water used in the aqueous TSP solution need not necessarily be heated. However, if the water is heated, it is easier and less time-consuming to dissolve the powdered or crystallized TSP in the water to prepare the required aqueous TSP solution.

After the TSP solution is prepared (401), using whatever method of preparation is chosen, the CRT funnel is washed with the aqueous TSP solution (402). This is preferably done, as described above, by spraying the TSP solution under pressure over and through the funnel. However, other means of washing the funnel with the TSP solution are within the scope of the present invention. For example, rinsing the funnel in a TSP solution that is not sprayed under pressure can be a method of cleaning the funnel with a TSP solution according to the present invention. Alternatively, immersing or dipping the funnel in a TSP solution can be a method of washing the CRT funnel with a TSP solution within the scope of the present invention. In such an example, the TSP solution bath into which the CRT funnel is immersed may or may not be agitated. Alternatively, a sponge or other porous cleaning medium can be soaked in the TSP solution and then used to wipe down the funnel. This method is also within the scope of washing the CRT funnel with a TSP solution according to the present invention.

After the CRT funnel is washed using the aqueous TSP solution, the CRT funnel is dried (403). This is preferably done, as described above, by forcing heated air through the washing chamber where the CRT funnel was washed using the aqueous TSP solution. Alternatively, the CRT funnel could be air-dried, wiped dry or dried by some other method within the scope of the present invention.

Figure 1:
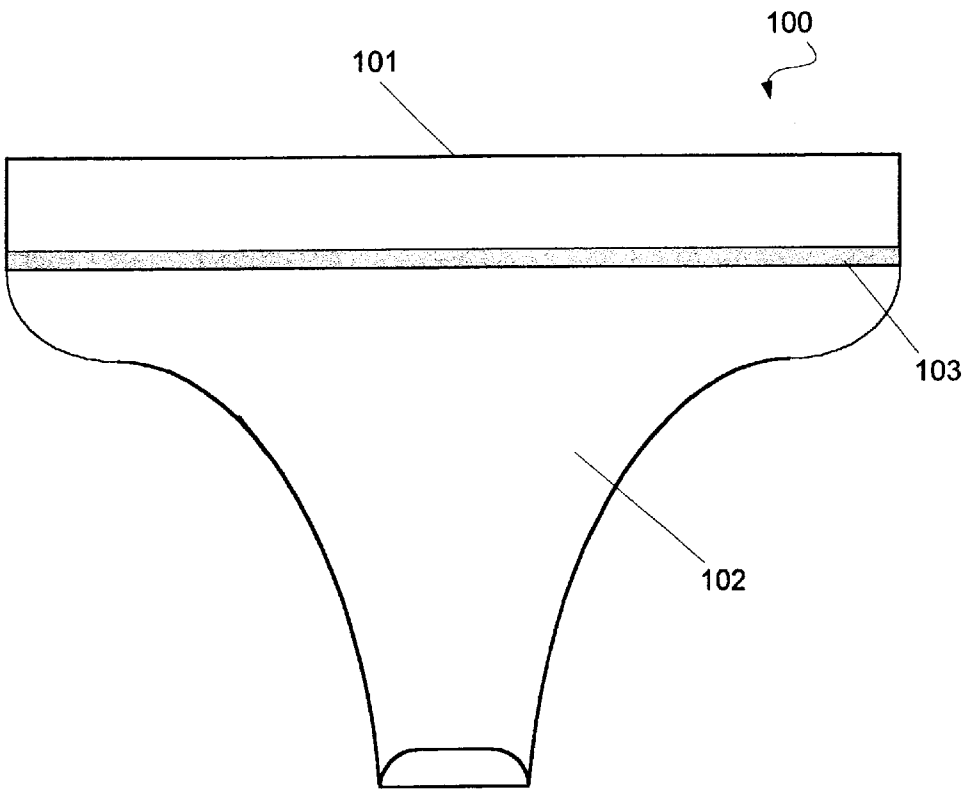
FIG. 1 is an illustration of a typical cathode ray tube to the manufacture of which the present invention can be profitably applied.
Figure 2:
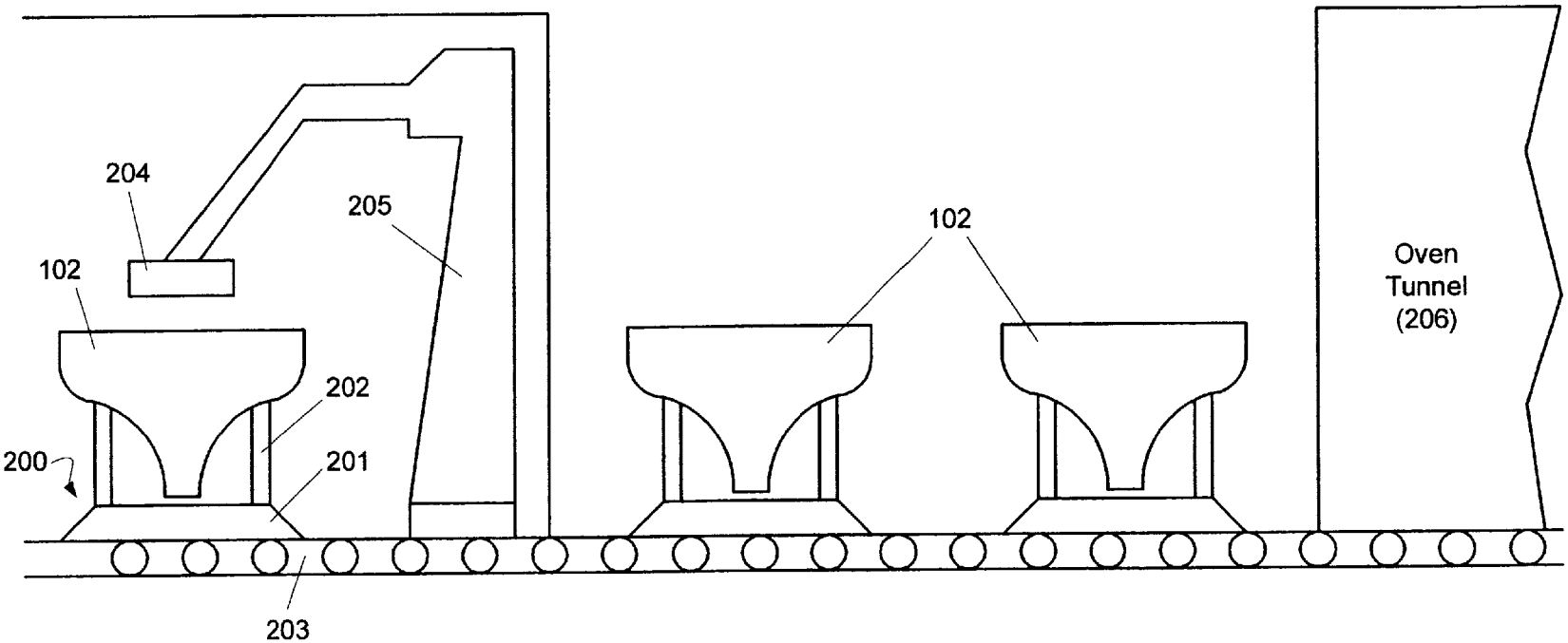
FIG. 2 is an illustration of a system for applying an interior coating of carbon material to cathode ray tube funnels after the funnels have been cleansed according to the principles of the present invention.

After the funnel has been washed and dried (402, 403), the funnel is transported to a station where a carbon material is coated on the interior of the funnel (404). This station is illustrated in FIG. 2. The carbon material is then coated on the interior of the funnel (405).

Consequently, the present invention provides an improved chemical wash for cleaning the interior surfaces of a cathode ray tube funnel prior to the application of a coating of carbon material inside the funnel. By replacing the traditional ammonium bifloride wash for CRT funnels with an aqueous solution of trisodium phosphate, the present invention provides a chemical wash that cleanses the CRT funnels as well as the ammonium bifloride wash previously used, but does not tend to clog the wash sprayers. Moreover, the TSP solution does not need to be treated before it is released as waste. As an additional advantage the TSP solution costs approximately a third of the cost of the ammonium bifloride wash.

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A method of cleansing an interior surface of a funnel of a cathode ray tube prior to application of a carbon material coating on said interior surface of said funnel, said method comprising washing said interior surface of said cathode ray tube funnel with an aqueous solution of trisodium phosphate.

2. The method of claim 1, further comprising preparing said aqueous solution of trisodium phosphate by mixing water and trisodium phosphate.

3. The method of claim 1, wherein said washing of said interior surface of said cathode ray tube funnel with said aqueous solution of trisodium phosphate further comprises spraying said aqueous solution of trisodium phosphate into said cathode ray tube funnel.

4. The method of claim 1, further comprising draining said aqueous solution of trisodium phosphate from a washing chamber where said washing of said interior surface of said cathode ray tube funnel is performed.

5. The method of claim 1, further comprising drying said cathode ray tube funnel following said washing of said interior surface of said cathode ray tube funnel with said aqueous solution of trisodium phosphate.

6. The method of claim 2, further comprising heating said water prior to said mixing of said water and said trisodium phosphate.

7. The method of claim 2, wherein said nixing of said water and said trisodium phosphate is performed automatically by connecting a water heater to a supply of trisodium phosphate.

8. The method of claim 4, further comprising discarding said aqueous solution of trisodium phosphate without further chemical treatment of said aqueous solution.

9. The method of claim 4, wherein said drying of said cathode ray tube funnel comprises heating air and blowing said heated air on said cathode ray tube funnel to dry said funnel.

10. The method of claim 9, further comprising extracting said heated air from said washing chamber in which said washing of said interior surface of said cathode ray tube funnel was performed.

11. A system for cleansing an interior surface of a funnel of a cathode ray tube prior to application of a carbon material coating on said interior surface of said funnel, said system comprising:

a washing chamber containing said funnel of said cathode ray tube; and an aqueous solution of trisodium phosphate supplied into said washing chamber to wash said interior surface of said funnel of said cathode ray tube.

12. The system of claim 11, further comprising:

a supply line for supplying said aqueous solution of trisodium phosphate to said washing chamber;

a metered supply of trisodium phosphate connected to said supply line; and a water line connected to said supply line.

13. The system of claim 11, further comprising:

a supply line for supplying said aqueous solution of trisodium phosphate to said washing chamber; and a sprayer connected to said supply line for spraying said aqueous solution on said funnel to clean said interior surface of said funnel.

14. The system of claim 11, further comprising a drain system connected to said washing chamber for draining said aqueous solution of trisodium phosphate from said washing chamber.

15. The system of claim 11, further comprising a drying system connected to said washing chamber for drying said cathode ray tube funnel following said washing of said interior surface of said cathode ray tube funnel with said aqueous solution of trisodium phosphate.

16. The system of claim 12, wherein said water line further comprises a water heater.

17. The system of claim 15 wherein said drying system comprises a heater/blower unit for heating air and blowing heated air into said washing chamber to dry said funnel.

18. The system of claim 17, further comprising an exhaust system connected to said washing chamber for exhausting said heated air from said washing chamber.

19. A system for cleansing an interior surface of a funnel of a cathode ray tube prior to application of a carbon material coating on said interior surface of said funnel, said system comprising:

a washing chamber containing said funnel of said cathode ray tube;

an aqueous solution of trisodium phosphate;

solution preparation means for preparing said aqueous solution of trisodium phosphate; and washing means in said washing chamber for washing an interior surface of said cathode ray tube funnel with said aqueous solution of trisodium phosphate, said washing means being connected to said solution preparation means.

20. The system of claim 19, wherein said solution preparation means comprise means for automatically mixing a pre-determined ratio of water and trisodium phosphate.

21. The system of claim 19, wherein said washing means comprise means for spraying said aqueous solution of trisodium phosphate into said cathode ray tube funnel to wash said interior surface of said cathode ray tube funnel.

22. The system of claim 19, further comprising means for drying said cathode ray tube funnel following said washing of said interior surface of said cathode ray tube funnel with said aqueous solution of trisodium phosphate, said drying means communicating with said washing chamber for drying said funnel in said washing chamber.

23. The system of claim 20, wherein said solution preparation means further comprise means for heating water for mixture with trisodium phosphate.

24. The system of claim 22, wherein said means for drying said cathode ray tube funnel comprise a heater/blower unit for heating air and for blowing said heated air on said cathode ray tube funnel to dry said funnel.

25. The system of claim 24, further comprising means, connected to said washing chamber, for extracting said heated air from said washing chamber.

* * * * *